US006309190B1

(12) United States Patent
Chen

(10) Patent No.: US 6,309,190 B1
(45) Date of Patent: Oct. 30, 2001

(54) SHAFT SUPPORTING STRUCTURE FOR AN AXIAL FAN

(75) Inventor: Chien-Jung Chen, Kaohsiung Hsien (TW)

(73) Assignee: Yen Sun Technic Industrial Corporation, Kaohsiung Hsien (TW)

( * ) Notice: Subject to any disclaimer, the term of this patent is extended or adjusted under 35 U.S.C. 154(b) by 0 days.

(21) Appl. No.: 09/493,616

(22) Filed: Jan. 28, 2000

(51) Int. Cl.[7] ..... F04B 17/00; F04B 35/04
(52) U.S. Cl. ..... 417/423.1
(58) Field of Search ..... 417/355, 356, 417/423.12, 423.14, 423.7; 415/229, 216.1, 220, 223

(56) References Cited

U.S. PATENT DOCUMENTS 4,361,776 * 11/1982 Hayashi et al. ..... 310/268
4,620,139 * 10/1986 Egami et al. ..... 318/254
4,861,237 * 8/1989 Shiraki et al. ..... 417/353
5,099,181 * 3/1992 Canon ..... 310/68 R
5,288,216 * 2/1994 Bolte ..... 417/423.7
5,492,458 * 2/1996 Horng ..... 417/423.7
5,967,763 * 10/1999 Horng ..... 417/423.7
5,997,265 * 12/1999 Chung ..... 417/423.7
5,997,267 * 12/1999 Lee ..... 417/423.7
6,000,919 * 12/1999 Hsieh ..... 417/423.15
6,050,785 * 4/2000 Horng ..... 417/354

* cited by examiner

*Primary Examiner*—Timothy S. Thorpe
*Assistant Examiner*—William H Rodriguez
(74) *Attorney, Agent, or Firm*—Larson & Taylor, PLC

(57) ABSTRACT

A shaft supporting structure for an axial fan includes a base and a casing. Electronic control elements are provided for driving the fan wheel under byvirtue of the induction of a coil. The fan wheel includes blades and a magnet ring that can be inducted for driving a central shaft thereof. The central shaft includes two ends that are respectively supported in an arcuate recess of a support member in the base and an arcuate recess of another support member in the casing.

3 Claims, 5 Drawing Sheets

SHAFT SUPPORTING STRUCTURE FOR AN AXIAL FAN

BACKGROUND OF THE INVENTION

1. Field of the Invention

The present invention relates to a shaft supporting structure for an axial fan.

2. Description of the Related Art

A typical heat-dissipating fan includes a fan mounted in a casing having an axle tube. A bearing means is force-fitted into the axle tube, a central shaft of the fan wheel (rotor) is extended through the bearing, and a retainer (e.g., a C-clip) is mounted in an annular groove in a distal end of the fan wheel, thereby rotatably mounting the central shaft of fan wheel in the axle tube on the casing. The bearing means may include a single bearing or two bearings. For example, Taiwan Utility Model Publication No. 235696 issued on Dec. 1, 1994 and entitled "IMPROVED SELF-LUBRICATING BEARING FOR COOLING FANS", as shown in FIG. 6 of the drawings, discloses a single bearing type structure, wherein the bearing 30 is engaged with an overall area of an inner periphery of the axle tube 23 for rotatably supporting the central shaft 14. Nevertheless, the assembly procedure is troublesome and wear is severe since the contact area between the central shaft and the bearing is increased. Longevity of the fan is thus shortened. Another type is disclosed in Taiwan Utility Model Publication No. 287588 issued on Oct. 1, 1996 and entitled "INTEGRAL CASING/AXLE TUBE FOR HEAT-DISSIPATING FANS", as shown in FIG. 7 of the drawings, which discloses a dual-bearing type structure, wherein two bearings 77, 78 are respectively mounted to two ends of the axle tube 76 by means of force-fitting to reduce contact area in a mediate portion of the axle tube 76. Nevertheless, a slight deviation or force-fitting difference during mounting of the bearings 77, 78 will result in misalignment in the central axis of the bearings 77, 78 and the central axis of the central shaft 91 of the fan wheel 90. As a result, rotation of the central shaft about a fixed axis cannot be guaranteed, and noise tends to occur.

SUMMARY OF THE INVENTION

It is a primary object of the present invention to provide a shaft supporting structure for an axial fan, wherein friction of the fan wheel shaft is reduced.

It is another object of the present invention to provide a shaft supporting structure for an axial fan, wherein the number of elements required for the bearing means is reduced to thereby reduce the manufacture cost.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
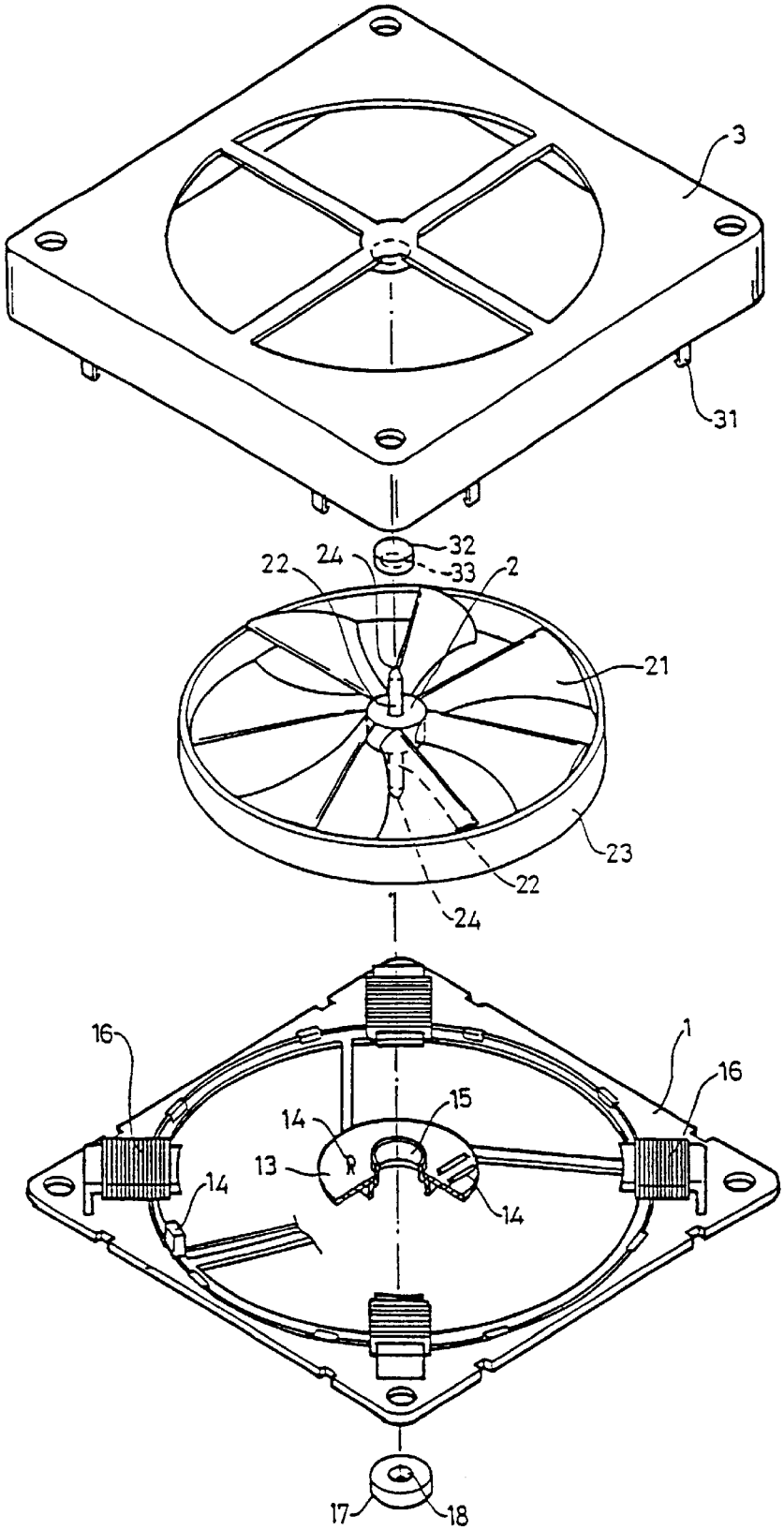
FIG. 1 is an exploded perspective view of an axial fan with a first embodiment of a shaft supporting structure in accordance with the present invention.
Figure 2:
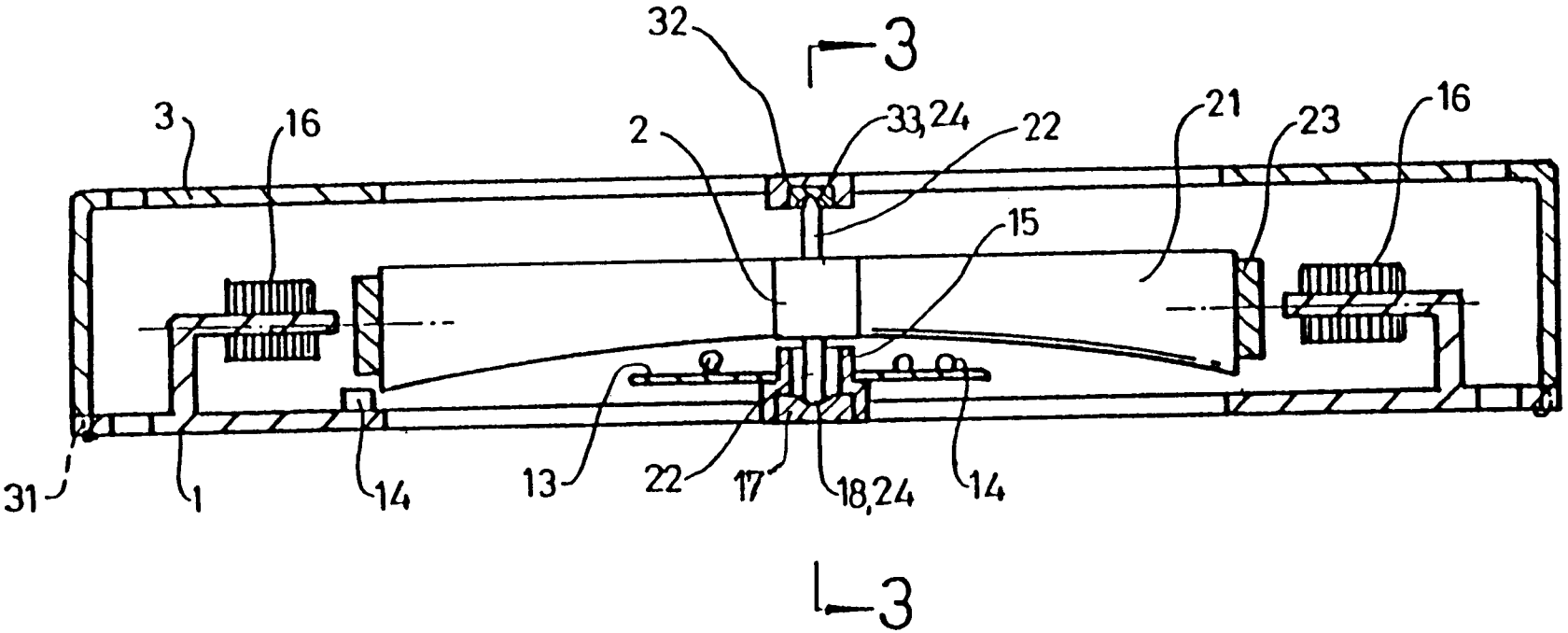
FIG. 2 is a sectional view of the axial fan in FIG. 1.

FIGS. 1 and 2 illustrate a preferred embodiment in accordance with the present invention generally that includes a base 1, a fan wheel 2, and a casing 3.

The base 1 is engaged with the casing 3 by means of engaging members (such as hooks 31) or other suitable means. Alternatively, the base 1 and the casing 3 may be integrally formed. The base 1 includes a mounting plate 13 having a plurality of electrical (electronic) control elements 14 mounted thereon for driving the fan wheel 2 to turn. The mounting plate 13 has an axle hole 15 through which a central shaft 22 of the fan wheel 2 extends. The base 1 further includes an induction coil means comprising a plurality of induction coils 16 controlled by the control elements 14 to drive the fan wheel 2. A support member 17 is securely mounted in the mounting plate 13 and includes an inwardly facing arcuate recess 18.

The fan wheel 2 includes a number of blades 21 which extend radially outward from a hub (not labeled) thereof. The fan wheel 2 includes a magnet ring 23 that cooperates with the coil means 16 on the base 1 for driving the fan wheel 2. The central shaft 22 made of abrasion-resistant material is mounted in a center of the hub and has two ends 24 which extend radially outward from the hub. The ends 24 are respectively received in the arcuate recess 18 of the support member 17 in the base 1 and an arcuate recess 33 of another support member 32 in the casing 33.

The casing 3 is engaged with the base 1 by the hooks 31 and includes a support member 32 securely mounted in a center thereof. The support member 32 may be integral with the casing 3. The support member 32 is made of abrasion-resistant material and includes an arcuate recess 33.

Figure 4:
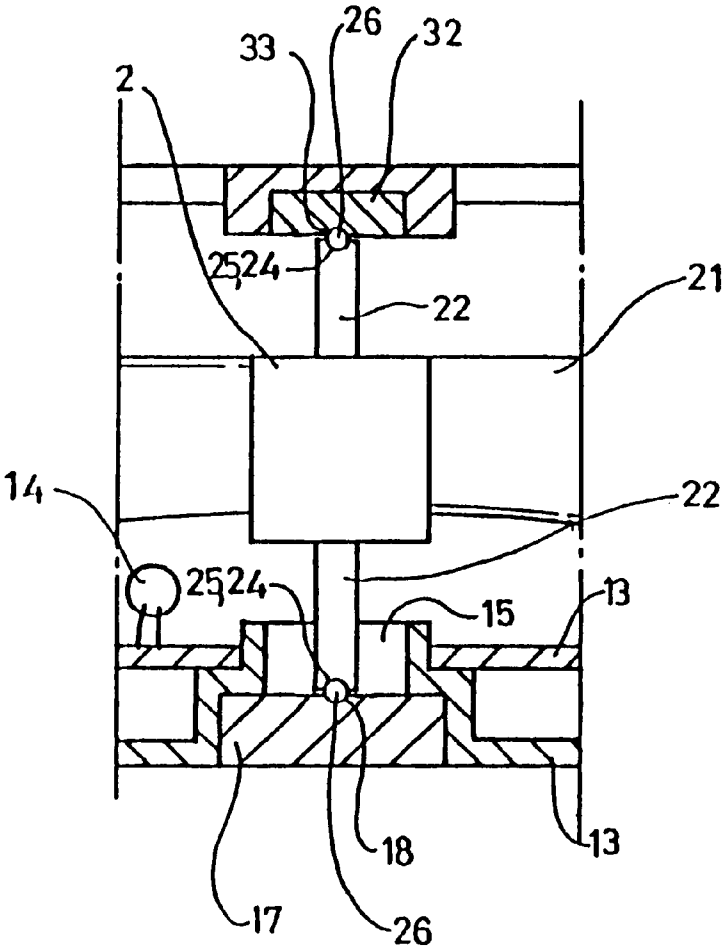
FIG. 4 is a sectional view similar to FIG. 3, illustrating a second embodiment of the shaft supporting structure in accordance with the present invention.
Figure 3:
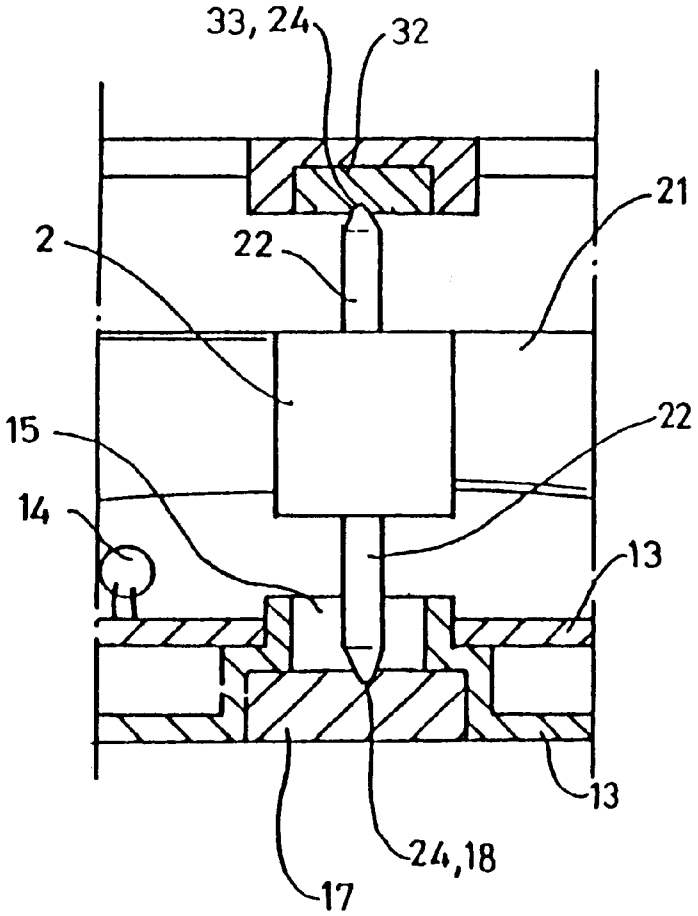
FIG. 3 is a sectional view, in an enlarged scale, taken along line 3—3 in FIG. 2.

More specifically the base 1 and the casing 3 respectively include a support member 17, 32 with an arcuate recess 18, 33. The support members 17, 32 may be integral with the base 1 and casing 3, respectively, or engaged with the base 1 and casing 3 by suitable means. The arcuate recess 18, 33 provides rotational support for an associated end 24 of the central shaft 22 of the fan wheel 2, best shown in FIGS. 2 and 3. As illustrated in FIG. 4, each end 24 of the central shaft 22 may include an arcuate recess 25 for receiving a ball 26 (made of abrasion-resistant material) between the respective arcuate recesses 18 and 25, and 33 and 25, thereby providing smoother rotation.

Figure 5:
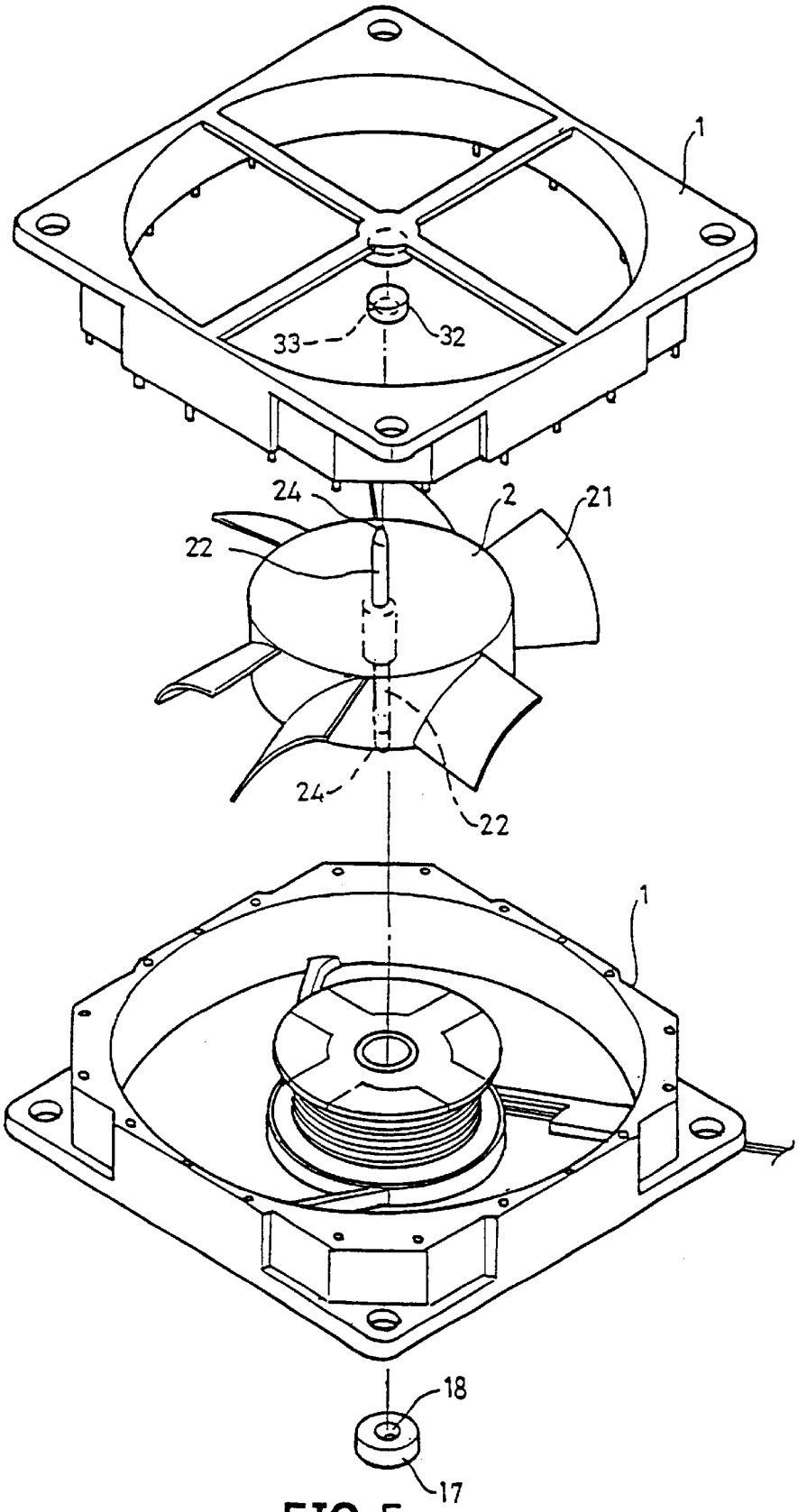
FIG. 5 is an exploded perspective view illustrating application of the shaft supporting structure in accordance with the present invention to an axial fan with a stator and a magnet ring.
Figure 7:
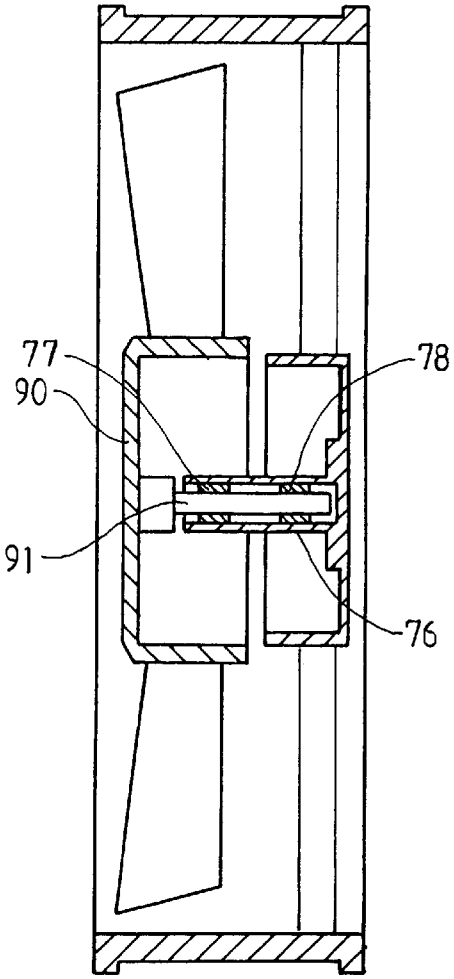
FIG. 7 PRIOR ART
FIG. 7 is a sectional view according to the other prior art.
Figure 6:
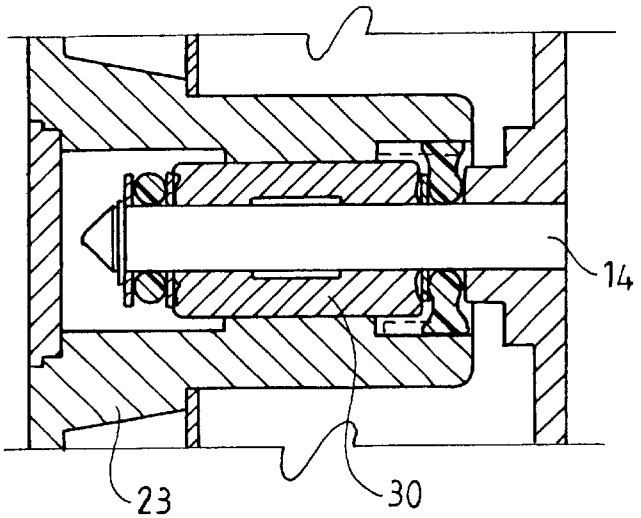
FIG. 6 PRIOR ART
FIG. 6 is a sectional view according to prior art.

FIG. 5 illustrates of the shaft supporting structure in accordance with the present invention to an axial fan with a stator and a magnet ring.

According to the above description, the contact area between the central shaft 3 of the fan wheel 2 and the bearing means (the support members 17 and 32) is relatively small, as there is only point contact therebetween. Accordingly, friction and wear are minimized during rotation of the fan wheel. Heat generated as a result of friction is also reduced. The number of bearings may also be reduced to thereby reduce the manufacture cost.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. A shaft supporting structure for an axial fan, comprising:

a base including a mounting plate with a plurality of electronic control elements thereon, the base further including at least one coil mounted thereon, the base further including a support member with an arcuate recess;

a fan wheel including a plurality of blades and a magnet ring, the fan wheel further including a central shaft extending outwardly from opposite sides of the fan wheel, the electronic control elements on the mounting plate controlling rotation of the central shaft of the fan wheel caused by induction between the magnet ring and the at least one coil, the central shaft including first and second ends, the first end of the central shaft being rotatably supported in the arcuate recess of the support member of the base;

a casing engaged with the base for protecting the fan wheel, the casing including a support member with an arcuate recess, the second end of the central shaft being rotatably supported in the arcuate recess of the support member of the casing; the support member and the central shaft being made of abrasion-resistant material.

2. The shaft supporting structure for an axial fan as claimed in claim 1, wherein the support member, the casing and the base are integrally formed or engaged with each other.

3. The shaft supporting structure for an axial fan as claimed in claim 1, wherein each end of the central shaft includes an arcuate recess for receiving a ball.

* * * * *